United States Patent [19]

Badia

[11] Patent Number: 4,878,418

[45] Date of Patent: Nov. 7, 1989

[54] DISTRIBUTOR FOR HYDRAULIC CYLINDERS

[75] Inventor: Jose M. Badia, Zaragoza, Spain

[73] Assignee: Hiab Foco AB, Hudiksvall, Sweden

[21] Appl. No.: 138,059

[22] Filed: Dec. 28, 1987

[30] Foreign Application Priority Data

Dec. 26, 1986 [ES] Spain ..... 8603601

[51] Int. Cl.[4] ..... F15B 11/08; F15B 13/04

[52] U.S. Cl. ..... 91/421; 91/435; 91/446; 91/468; 91/451; 137/625.68; 137/596.2

[58] Field of Search ..... 91/435, 449, 450, 451, 91/468, 452, 421, 433, 434, 446, 468, 432; 137/625.68, 596.2

[56] References Cited

U.S. PATENT DOCUMENTS

| | | | |
|---|---|---|---|
| 3,906,980 | 9/1975 | Hanser et al. | 91/421 |
| 4,117,862 | 10/1978 | Qureshi | 137/596.13 |
| 4,140,152 | 2/1979 | Budzich | 91/421 |
| 4,388,946 | 6/1983 | Richter | 137/596.2 |
| 4,518,004 | 5/1985 | Hsu et al. | 91/446 |
| 4,548,239 | 10/1985 | Eskildsen | 91/446 |
| 4,610,194 | 9/1986 | Budzich | 91/421 |
| 4,694,731 | 9/1987 | Budzich | 91/421 |
| 4,706,547 | 11/1987 | LeBlon | 91/446 |
| 4,738,279 | 4/1988 | Kropp | 91/446 |

FOREIGN PATENT DOCUMENTS

| | | | |
|---|---|---|---|
| 2343662 | 3/1975 | Fed. Rep. of Germany . | |
| 3346463 | 7/1984 | Fed. Rep. of Germany | 137/625.68 |
| 0200773 | 12/1982 | Japan | 137/625.68 |
| 2149887 | 6/1985 | United Kingdom | 137/625.68 |

*Primary Examiner*—Robert E. Garrett
*Assistant Examiner*—Thomas Denion
*Attorney, Agent, or Firm*—McFadden, Fincham, Marcus & Allen

[57] ABSTRACT

A distributor for hydraulic cylinders (2), especially applicable to crane drive cylinders, which comprises an axial sliding runner (4) for selection of the oil circuit. Said runner (4) is hollow, forming two separate chambers (19,20) adjacent to the cylinder chamber supply and return ducts with which it is connected through holes in the wall of the said runner. One of the chambers (19) includes means for varying the degree to which the holes are opened, according to the return oil pressure from the cylinder withdrawal chamber. The other chamber (20) incorporates means for opening or closing the connection through it, according to the pressure being delivered by the pump, to the cylinder withdrawal chamber oil supply duct. Thus it is possible to regulate the flow as an inverse function of the load and to reduce the effect of induced pressure.

7 Claims, 7 Drawing Sheets

DISTRIBUTOR FOR HYDRAULIC CYLINDERS

This invention refers to a distributor for hydraulic cylinders, in particular for two-way hydraulic cylinders, comprising an advance and a withdrawal chamber situated one on each side of the cylinder piston or plunger.

In more specific terms, the distributor of this invention is applicable to two-way hydraulic cylinders intended to move mobile apparatus or elements where the speed of displacement of the apparatus influences the maximum capability of the assembly.

This is the case with all equipment or apparatus designed to handle loads, basically when such loads must be moved vertically, as in lifting apparatus.

Examples of equipment or apparatus where these circumstances come together are tip or swivel platforms, hydraulic apparatus and equipment used to load and unload trucks, fork-lift trucks which are hydraulically operated and, fundamentally, cranes, because of their greater load displacement speed.

It is known that the various movements of the jibs of a crane are obtained from hydraulic cylinders which are controlled by a two-way distributor. This distributor is composed of a body which, for each cylinder of the crane, forms a lengthwise through housing which contains a runner that can be moved axially; two chambers, one each for the safety valves; two intermediate inlet ducts for oil from a feed pump, which enter the lengthwise housing radially; two ducts, one of which runs between the cylinder advance chamber and the lengthwise housing, and the other between the cylinder withdrawal chamber and the lengthwise housing, thus lying one on each side of the intermediate oil inlet ducts, providing the supply and return of the oil for these chambers; and finally, the said body forms two ducts, also for each cylinder of the crane, for return of the oil to its deposit tank, running between the lengthwise housing and the safety valve chambers, and each located close to one of the aforementioned supply ducts.

The above-mentioned runner is made up of a cylindrical body which has peripheral throat sections on its surface whose size and location are such that, when the said cylindrical body is moved, it connects one of the intermediate ducts with one of those supplying oil to the cylinder chambers, so as to move the plunger in that cylinder in one direction or the other; in addition, it provides connection with one of the oil supply ducts to the adjacent return duct to the tank so as to allow the oil out of the chamber of the cylinder whose volume is reduced. By selecting the position of the runner, it is possible to advance or withdraw the cylinder plunger and, thereby, to raise or lower the associated jib of the crane.

Calculation of the structure of a crane is done by analysis of the fatigues produced in the different sections by means of the application of forces and moments on the x, y and z axes. The main load to be borne by the crane is determined by the value of the maximum useful load at maximum reach, with the crane at rest, and increased by a coefficient—the so-called $\Psi$ factor — which is a function of the vertical speed of the load.

The maximum vertical speed of the load is fixed by the instantaneous speed produced by the movement of the elevation or articulation cylinder, if any. Whichever induces the higher instantaneous speed fixes the value of the factor referred to. According to the foregoing, in order to increase the principal or total load which a crane may carry, it is possible only to act on the size or strength of the crane's structure, or else on the $\Psi$ factor which, as has been said, is a function of the vertical speed of the load.

The first possibility does not present any problem, since with the appropriate calculation the structure's specifications can be exactly determined. However, for any crane manufacturer, the solution is not to increase the strength of the structure by increasing its size, but rather, with the same structure, to enable the crane to handle the maximum possible load.

The second possibility mentioned for increasing the maximum load which can be handled by a crane consists of reducing the $\Psi$ factor which, as pointed out, is a function of the vertical speed of the load. In this sense, it is known that the provision of the crane's hydraulic circuit with a constant flow valve for the regulation of the oil flow makes it possible to control the descent speed of the load. There are a number of problems associated with this solution.

On the one hand, the provision of a constant flow valve means that the crane speed is maintained irrespective of the crane position and the load being carried; Where the flow control results in too low a speed, aimed at increasing the maximum load, the crane's movements will be too slow for operations with loads of less than the maximum; thus it is not advisable to reduce the speed to less than a certain value.

On the other hand, during the downward phase of the load, an effect is created of uncontrolled pressure in the cylinder drive chamber. This is because in this chamber and, as a result, in the rest of the hydraulic circuit from there on, the pressure present is that which corresponds to the load being handled, plus that induced by the thrust created in the opposing chamber of the hydraulic cylinder, as a result of the entry of oil under pressure in that opposing chamber during the descent phase. This uncontrolled pressure has an adverse effect as far as safety is concerned, for the following reasons; excess pressure which is not taken into account in the calculation of the cylinder, and excess pressure which affects the flexible ducts and piping. The pressure increase caused by the effect described can be as much as 50–60% of the value of the pressure in the rod chamber, chiefly when the load is at its maximum, or close to its maximum.

In the same way, an effect of uncontrolled flow is produced from the cylinder drive chamber onwards during the load descent phase. For the same reasons as above, which create the effect of uncontrolled pressure, there is as well an increase in the outlet flow from the cylinder drive chamber, because the flow controlled by the constant flow valve must be augmented by the flow which, in a derivation, is released through the corresponding chamber pressure control valve for that cylinder. This means that the total outlet flow is much higher than the level planned for, so that the descent speed also rises. This effect occurs when the crane is handling maximum or nearmaximum loads in which case, because of the induced pressure effect already referred to, there is pressure in the pressure control valve which is due to the load plus induced pressure, so that levels are reached which are in excess of the security valve setting, so that this valve opens, even before reaching maximum load as calculated for the crane. This problem could be overcome by placing the flow control valve upstream of the safety valve but, in this case, the safety valve would not operate for the part of the circuit which is located upstream of the flow control valve.

The purpose of this invention is to provide a distributor which ensures a control of the flow in the hydraulic circuit which is an inverse function of the load being handled by the crane, thus providing a variation in the vertical speed of the load which is also an inverse function of the value of this load.

With this system, when the load suspended from the crane is at its maximum or near-maximum, the vertical speed of this load drops, and with it the Ψ factor, so that the maximum useful load can be raised, and the maximum load/Ψ factor product remains constant.

In short, this invention allows for the crane's maximum useful load, by means of reductions in the vertical speed of the load, which are only appreciable for the maximum or near-maximum so that, for lower loads, the crane's operating speed is at the maximum nominal rating.

To meet this objective, the invention also resolves the problem in induced pressures, minimizing or eliminating them, at least when the crane is handling maximum or near-maximum loads. A further advantage of the invention is its ability to differentiate "Pressure due to load" from "Induced pressure" so that, throughout the control movement, the device reacts only to variations in pressure due to changes in load, and ignoring any increase in pressure from other sources. In turn, this generates greater system stability by reducing the pressure fluctuations.

On the other hand, the pilot valve which is increasingly being used, gives flow control interactions so that, at flows which are below the nominal values, it is this valve which controls the flow; this means that the system does not suffer or note the pressure produced by the load. When the planned flow limit is reached, the control function is transferred to the system which, in turn, alters the induced pressure which indirectly pilots the block valve. Thus the control can be passed back and forth between the block valve and the system so that the whole system assumes a resonant frequency condition; this would create a downward movement by jerks. The invention has the further aim of suppressing the functions of the pilot block valve so that these problems are overcome without affecting the safety features of this valve. In short, the distributor of this invention provides flow control as an inverse function of the load, a reduction of the "induced pressure" effect, the flow change device is dependent solely and exclusively upon the lifting load, and finally, it suppresses the functions of the pilot block valve, without impairing the safety features of this valve.

In order to meet these objectives pursuant to the invention, the cylindrical body which forms the runner is hollow throughout its length, and is closed by covers at the ends. From these closed ends, the interior of this body forms two separate chambers; the first is adjacent to the ducts for supply and return of oil for the crane's cylinder advance chamber, while the second is adjacent to the ducts for the supply and return of oil for the cylinder withdrawal chamber. On each of these chambers, there is one of the peripheral throats of the runner which will provide the interconnection between one group of ducts and the other.

Said first chamber of the runner has in its side three sets of through holes, two sets of which run from the surface of the peripheral throat, and the third of which runs from a point close to the said throat, between it and the nearest end of the runner.

The second chamber has two sets of through holes in its side, one of which runs from the peripheral throat's surface and the other from points close to the said throat, between it and the nearest end of the runner.

The holes of the first of these chambers define a passage for the circulation of oil between the supply and the return ducts for the oil to the cylinder advance chamber when the runner is in the down position for the cylinder. In this position, the peripheral throat outside this chamber is axially displaced in relation to the duct for the return of the oil to the tank from the cylinder advance chamber, but without creating a connection between this duct and the one for the supply of oil to the advance chamber of this cylinder.

The second chamber and its holes, in the same runner position, form a passage between the duct for the supply of oil to the cylinder withdrawal chamber and the tank return duct.

The first chamber has means for altering the bore of this passage, according to the pressure of the oil returning from the cylinder withdrawal chamber, while the second has devices for opening or closing the interconnection through it as a function of the pressure of the oil being introduced from the pump into the duct for supply to the cylinder withdrawal chamber.

The two sets of holes in the first chamber which run from the adjacent peripheral throat are located close together, from the inside wall or side of the peripheral throat, and they form a smaller-bore passage than the mouth on the runner of the duct for the supply of oil to the cylinder advance chamber. In this way, when the oil flows through the first chamber, the oil pressure inside will be less than that in the peripheral throat, because of the smaller bore of the two sets of holes referred to previously.

The devices also referred to above for the alteration in the first chamber of the bore of the passage formed through it consist of a first plunger, adjacent to the end of the runner, which is intended to vary the bore of the third set of holes in this chamber, and of a second plunger intended to alter the bore of the intermediate set of holes. The base of the first of these plungers is adjacent to the second, under the pressure in the chamber and under the tension from a spring which is fitted between the two plungers; its opposite base, which points towards the nearer end of the runner, is under pressure from the external peripheral throat where the cylinder advance chamber oil supply duct enters. This pressure is obtained through an interconnection passage which runs from this throat and discharges behind the base of the plunger. The second plunger referred to has opposed bases of different cross-section, both of which are under the pressure from the chamber and, as well, that from the tension of a spring, on the one hand, which is located between the two plungers and, on the other hand, from an adjustable spring which is set to a value equal or close to the pressure due to the maximum crane load.

The second plunger has two heads at the ends and an intermediate body of a small cross-section; the head alongside the first plunger is of a larger cross-section than the one opposite. The central body is hollow and runs into the chamber through full-length longitudinal ports and through the head adjacent to the first plunger. Moreover, this second plunger can be moved between two limit positions; in one position, the chamber's intermediate set of holes is fully opened, with the chamber displaced towards the first plunger while, in the other, these holes are completely closed and, through the smaller head, it is seated upon a base formed inside the chamber.

In addition, by means of the smaller head, the second plunger is rested upon an intermediate plunger which is of considerably smaller cross-section, which reaches as far as the second chamber by means of a passage which has hermetic seal devices between the first and second chambers. On the one hand, this smaller plunger is subject to pressure in the first chamber while, one the other, it comes under the tension of the adjustable spring which acts on the second plunger.

The devices in the second chamber for the opening or closing of the passage through it consist of a reel fitted inside the chamber which can slide axially. This reel has two end heads of the same size as the inside of the chamber, and an intermeidate body of smaller cross-section which, with the heads and the inside surface of this chamber, forms a ring-shaped space. This reel has an axial hole from the free base adjacent to the end of the runner; this is a blind opening, between which and the aforesaid ring-shaped space; there is a connecting hole; with opposite base, it rests on the intermediate plunger of the first chamber, and fitting a fixed rod neatly into the said axial hole. This rod is secured to an end plug screwed inside the second chamber. Between this plug and the reel, there is a spring which propels the runner towards the intermediate plunger, and through which it acts on the second plunger of chamber number one, so as to define the adjustable spring which has been referred to, the tension from which is exerted against this second plunger. In addition, the reel is displaceable under the force of the aforesaid spring and of the second plunger of the first chamber, through the intermediate plunger, between two end positions, one displaced towards the adjacent end of the runner, with the two sets of holes in the second chamber opening into the ring-shaped space formed by the reel, and the other displaced in the opposite direction, where only the the set of holes from the bottom of the peripheral throat run into this ring space. This throat is thus at all times connected to the duct which supplies oil to the cylinder withdrawal chamber.

The intermediate plunger and the fixed rod oused in the reel hole have transversal sections which are of the same proportion as those of the cylinder plunger in the advance and withdrawal chambers.

The characteristics set out, and the effects obtained with the distributor of this invention are explained by way of continuation in greater detail, with reference to the attached drawings, which show a preferred design, given by way of illustration, and without limitation. In the said drawings.

Figure 1:
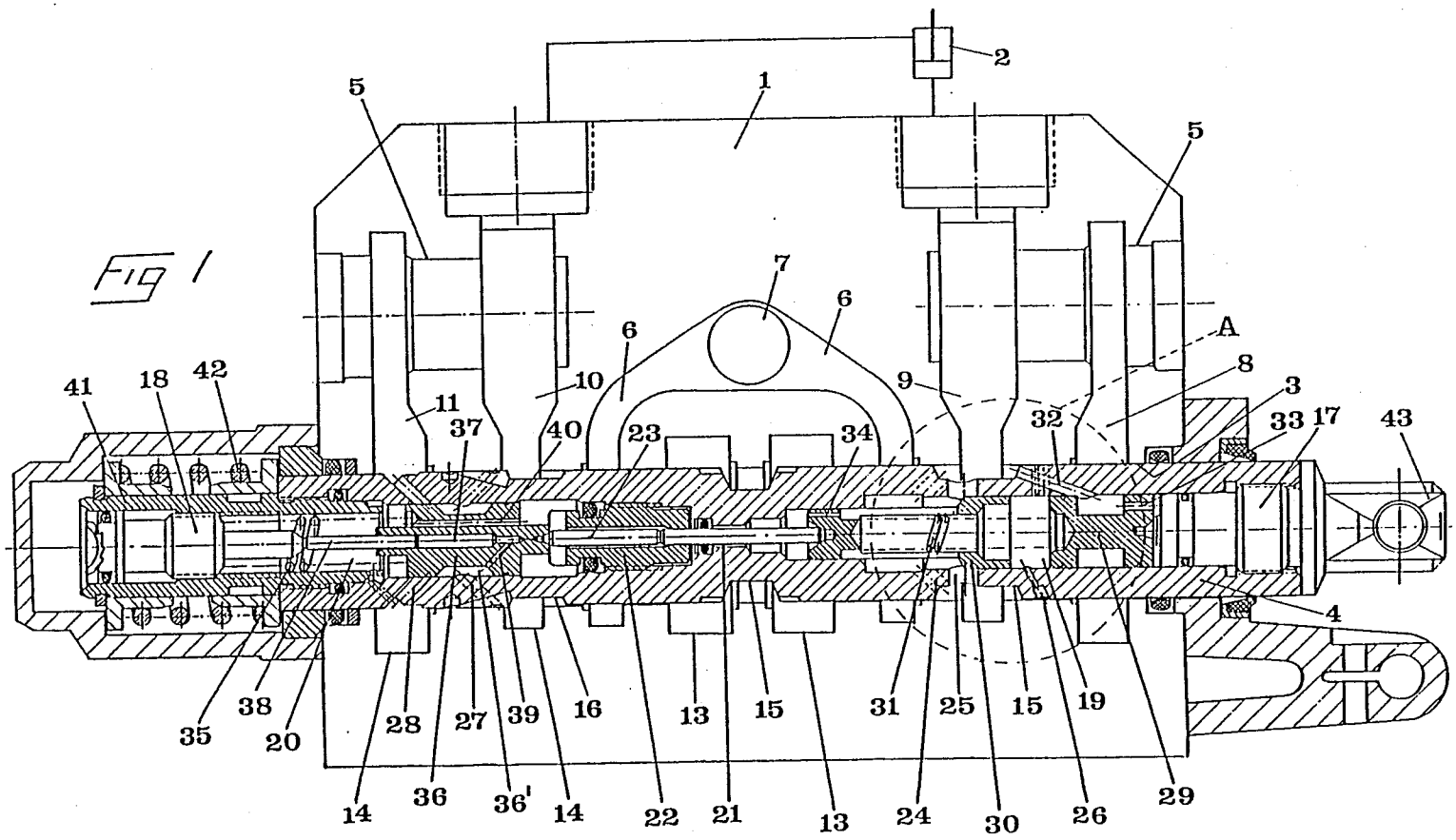
FIG. 1 shows a two-way distributor designed according to this invention, in lengthwise cross-section, with the runner, the connection ducts and chambers for the safety valves, for one of the upward and downward cylinders of a crane, said runner being in the closed position, where the cylinder is at rest and the oil from the pump returns directly to the tank.

As can be seen from FIG. 1, the distributor consists of a body 1 which, for each crane cylinder, includes the following: A lengthwise through housing 3 in which a runner 4 is mounted and can be moved axially. Two chambers 5 for two safety valves (not shown) of a known design. Two intermediate ducts 6 for the entry of oil from a supply pump, which run between a central port 7 and the housing 3. Four ducts 8,9,10,11 of which two, namely the ducts 9 and 10 are located on each side of the intermediate ducts 6 for the supply and return of the oil for the advance and withdrawal chambers 45,46 of the cylinder 2, and between the housing 3 and the chambers 5 for the safety valves, while the ducts 8,11 are for the return of the oil to the tank or deposit, from the cylinder's advance and withdrawal chambers, and also run between the lengthwise housing 3 and the chambers 5 for the safety valves.

The body 1 also forms intermediate chambers for the direct return of the oil supplied by the pump to the tank, with the runner in the position shown in FIG. 1, which is also the rest position of the cylinder 2.

At the point where each of the ducts referred to emerges, the housing 3 has peripheral offsets 14.

Runner 4 is provided with an intermediate peripheral throat 15 which provides interconnection between the chambers 13 in the housing 3, with the runner in the position of FIG. 1. Furthermore, the runner 4 has intermediate periheral throats 15 and 16 in order to connect one of the intermediate ducts 6 with one of the adjacent ones, 9 or 10, or to interconnect ducts 8 and 9 or ducts 10 and 11, as explained below.

According to the invention the runner 4 is hollow throughout its length, and it is closed by end plugs 17 and 18. From these plugs onwards, two separate chambers 19,20 are formed, the first of which 19 is separated from the second 20 in the example described, by an intermediate narrowing 21 and a fixed body 22. Inside this narrowed section and body there is an intermediate plunger 23 with seal elements placed against the surface of this plunger, and between the fixed body 22 and the inside surface of the runner.

The first chamber 19 has three sets of holes 24,25,26 through its side. The holes 24 and 25 run into the peripheral throat 15 while the hole 26 is located close to the said throat, between it and the plug 17.

For its part, the second chamber 20 has two sets of holes 27,28 in its wall, the first one of which runs into the peripheral throat 16 while the second one 28 is located close to the throat and between it and plug 18.

The first chamber 19 contains a first plunger 29 and a second one 30. The latter is hollow and houses a spring 31 which is set against plunger 29.

Said first plunger 29 is subject, on the face adjacent to the second, to the pressure in chamber 19 plus the tension from a spring 31. On the opposite side it is under the pressure from the peripheral throat 15 thanks to holes 32 and 33. For its part, the plunger 30 is under pressure, on the face adjacent to plunger 29, from chamber 19 plus the tension of spring 31 while, on the other side, it is under pressure from chamber 19 through duct 34 and from a spring 35 through intermediate plunger 23 as will be explained immediately. The lengthwise hollow of plunger 30 in which spring 31 is located, runs out peripherally through longitudinal openings. This plunger, as can be seen, has end heads of different sizes, the one closest to plunger 29 being the larger.

In the second chamber 20 a reel 36 is housed. The reel has end heads of the same size and an intermediate body of reduced dimensions, which forms a ring-shaped chamber 36' in which one or both sets of ducts 27 and 28 are discharged. Reel 36 has, from the base adjacent to plug 18, an axial port or opening 37 which is blind, and inside which there is a rod 38 secured to plug 18. The said axial opening 37 is connected to the ring-shaped chamber 36' through the oblique hole 39. In addition, the front and back faces of the reel 36 are connected through an axial hole 40. Thus, reel 36 is subject, on the face next to the plug 18, to the pressure from the spring 35 plus the effect of the pressure of the oil in the ring-shaped chamber 36' on the section of hole 37. The opposite face comes under the thrust of the plunger 30 in chamber number one, through intermediate plunger 23. The action of spring 35 is transmitted through reel 36 and that of intermediate plunger 23 to plunger 30 of chamber number one. Plug 18 is screwed inside a bush 41 secured to runner 4 so that it is possible to adjust the axial position of this plug and, therefore, the tension of spring 35. Inside bush 41 there are seal gaskets. On the outside it has a positioner and stroke-limiter 42 which, as such, is not new.

Plug 17 is topped on the outside by a lug 43 for fixing the operating lever.

In FIG. 1, the runner 4 is in a position where there is no connection between any pair of ducts, but only between the intermediate chambers 13, so that the oil from the pump flows directly back to the storage tank.

Figure 2:
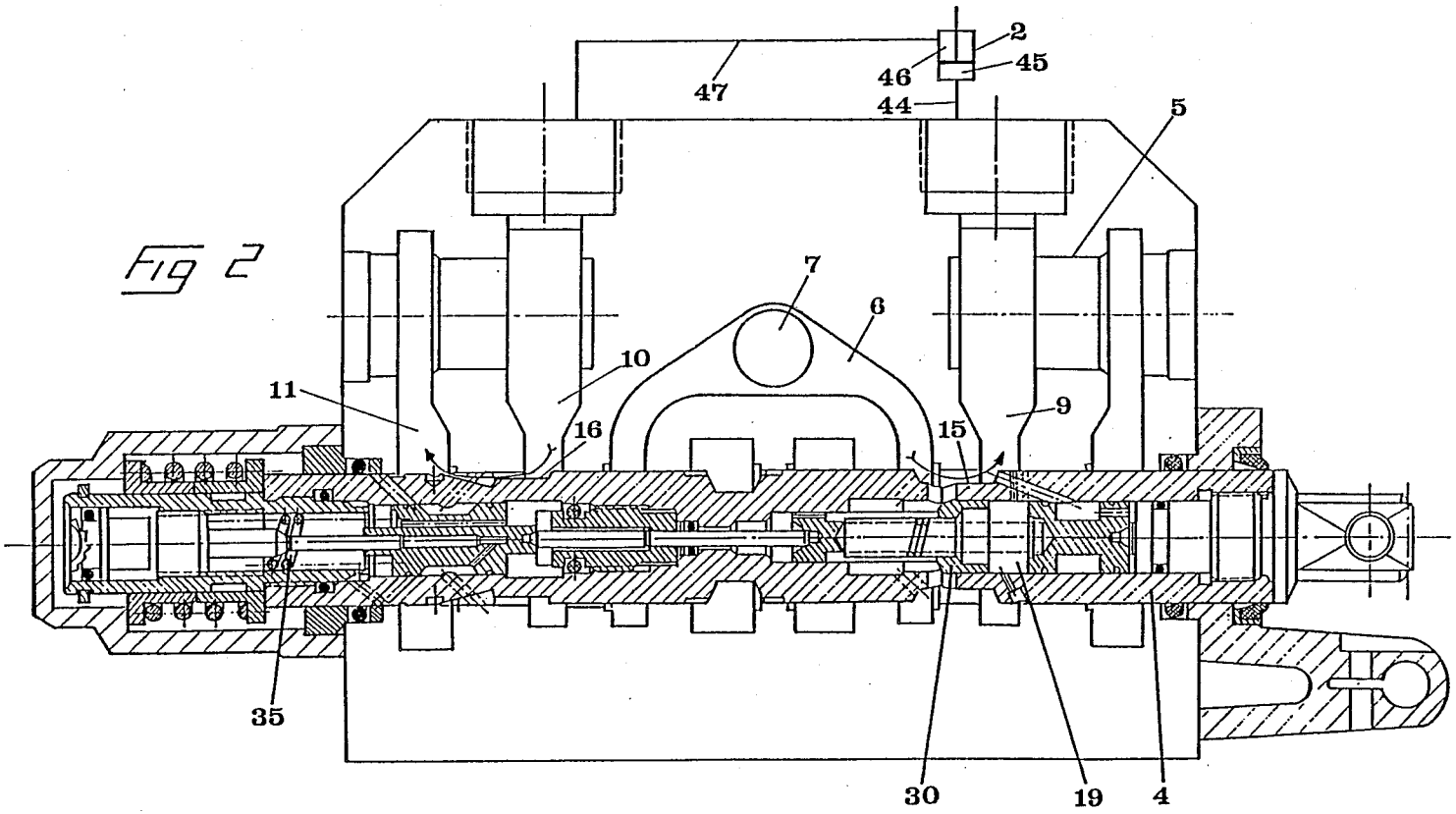
FIG. 2 is a cross-section view similar to that in FIG. 1, in which the runner is moved to a position for the hoisting of the hydraulic cylinder.

When the runner 4 moves to the left, in the position shown in FIG. 2, ducts 6 and 9 are linked through peripheral throat 15 so that the oil from port 7 runs through the safety valve in chamber 5 and, through a duct 44 to the operating or advance chamber 45 of the hydraulic cylinder 2. At the same time, the oil in the withdrawal chamber 46 of cylinder 2 runs out through duct 47 and through the corresponding safety valve to duct 10 which is open to duct 11 through the peripheral throat 16. The returning oil thus flows from duct 11 through the safety valve and back to the storage tank. The elevation phase of the hydraulic cylinder 2 is thus produced.

Figure 4:
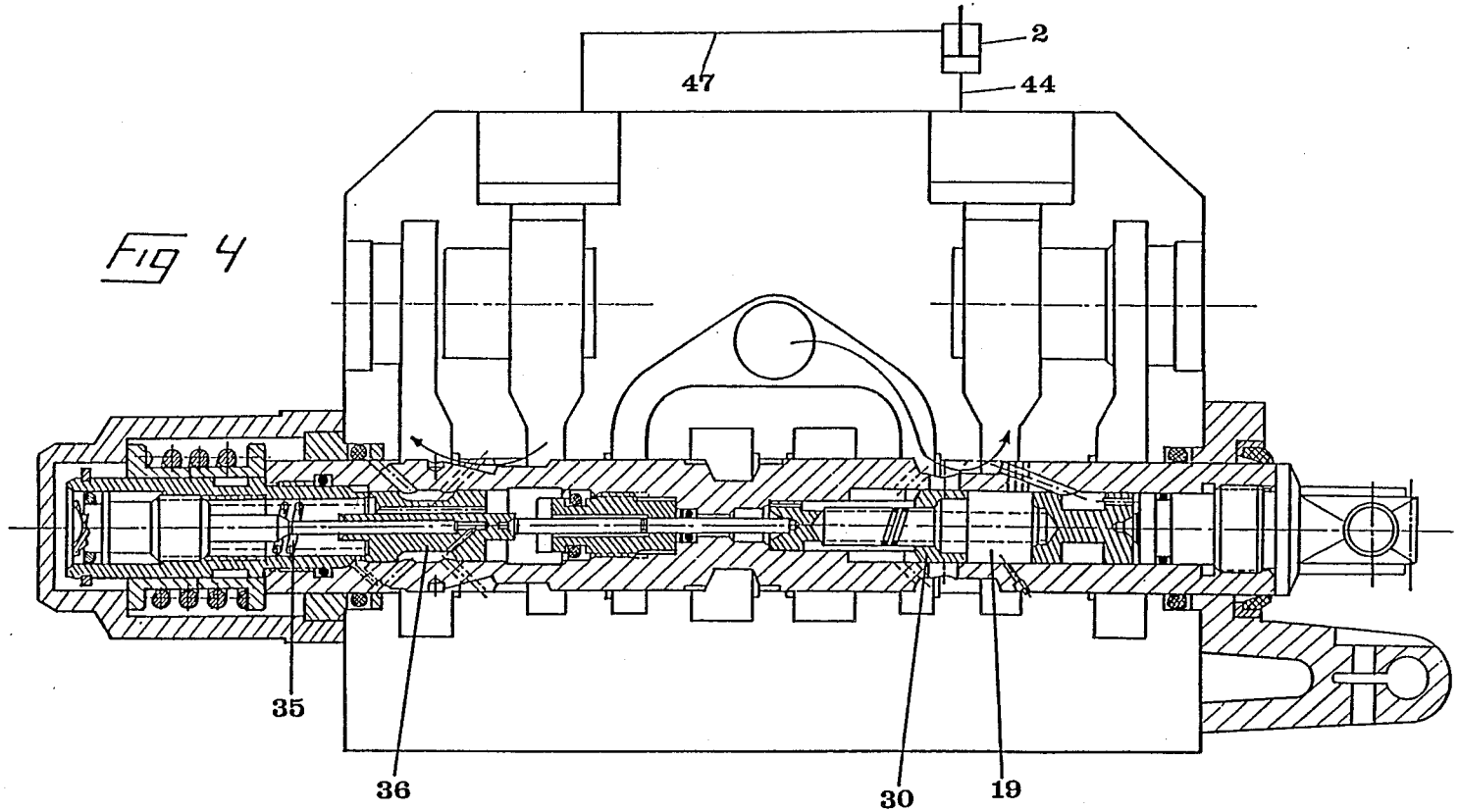
FIG. 4 shows a view similar to that in FIG. 1, with the runner in the same position as in FIG. 2, for elevation of the cylinder, but with the system under a higher hoist pressure.

It may occur that the increase in pressure of the oil supplied by the pump, which increases the pressure in the chamber 19, will move the plunger 30 to the left, occupying the position shown in FIG. 4, as this plunger has free surfaces of different sections, both of which are under the pressure from chamber 19. The movement of the plunger 30 also causes the movement of the reel 36 without affecting the circulation of oil towards the cylinder 2 drive chamber. The movement of plunger 30 as shown in FIG. 4 will take place when the pressure increase, due to the different end sections of this plunger 30, overcomes the tension in spring 35. The arrows in FIGS. 2 and 4 show the movement of the oil to the cylinder advance chamber, and from its withdrawal chamber.

Figure 3:
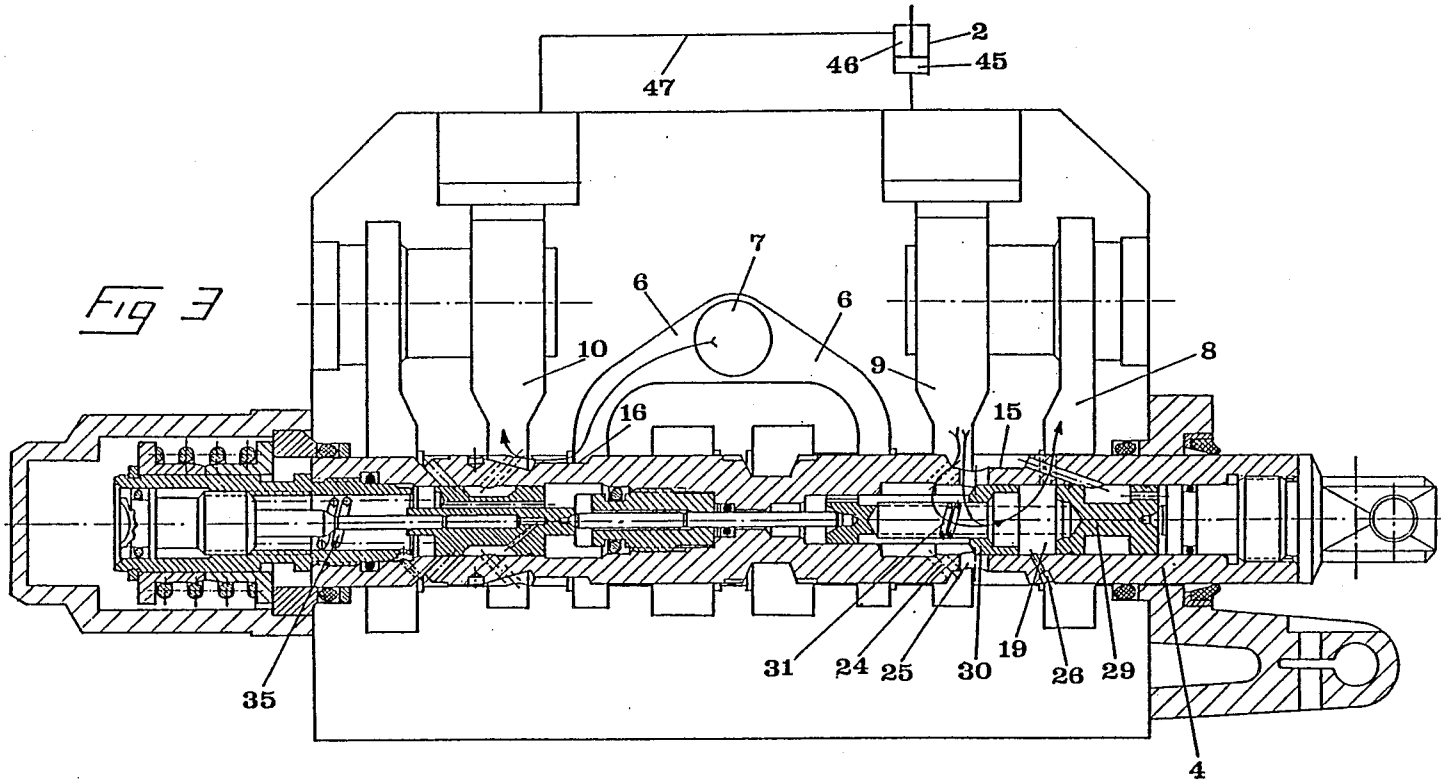
FIG. 3 shows a view similar to the one in FIG. 1, with the runner moved to a position for the descent of the hydraulic cylinder.

The position of runner 4 is inverted for the crane's descent, so that it moves to the right to come into the position in FIG. 3. Now, the oil from the pump, arriving through port 7, flows through duct 6 and peripheral throat 16 to duct 10, and through the safety valve to duct 47 and so into the withdrawal chamber 46 of the cylinder 2. The oil in the advance chamber 45 of this cylinder flows through the safety valve to reach duct 9. Because in the FIG. 3 runner position there is no connection between ducts 9 and 8 through peripheral throat 15, the oil reaching duct 9 flows into chamber 19 through the hole 24 and 25, the latter of which are partly closed by the position of plunger 30. The oil, following the path marked in the drawing, runs out through holes 26 to duct 8, from which it returns to the tank through the safety valve.

The position of plunger 30 depends on the pressure in chamber 19. The higher this pressure, the greater the displacement of the plunger 30 to the left will be, because its end sections are of different dimensions and both are under the same pressure. Thus, pressure increases in chamber 19 will move the plunger 30 to the left as the spring 35 tension is gradually overcome.

Moreover, the first plunger 29 contributes to this effect; the face adjacent to plunger 30 is under the pressure of chamber 19 while the rear face is under that in the peripheral throat 15.

In the passage formed by the sets of holes 24 and 25, the oil flowing from duct 9 to chamber 19 undergoes a drop in pressure. The higher the pressure and flow in duct 9, the greater the pressure difference in this duct and in chamber 19. This pressure difference is the one which acts on the faces of the first plunger 29 to move it leftwards, and similarly assisting in the movement of plunger 30. Spring 31 is set so that the first plunger 29 begins to move leftwards when the pressure differences exceed a given value. The movement of this plunger 29 will gradually close the the series of holes marked 26, in proportion to the increase in pressure in duct 9. All this translates into a constant flow of oil and, therefore, a smooth crane descent. The plunger 29 acts as a constant flow valve.

Figure 5:
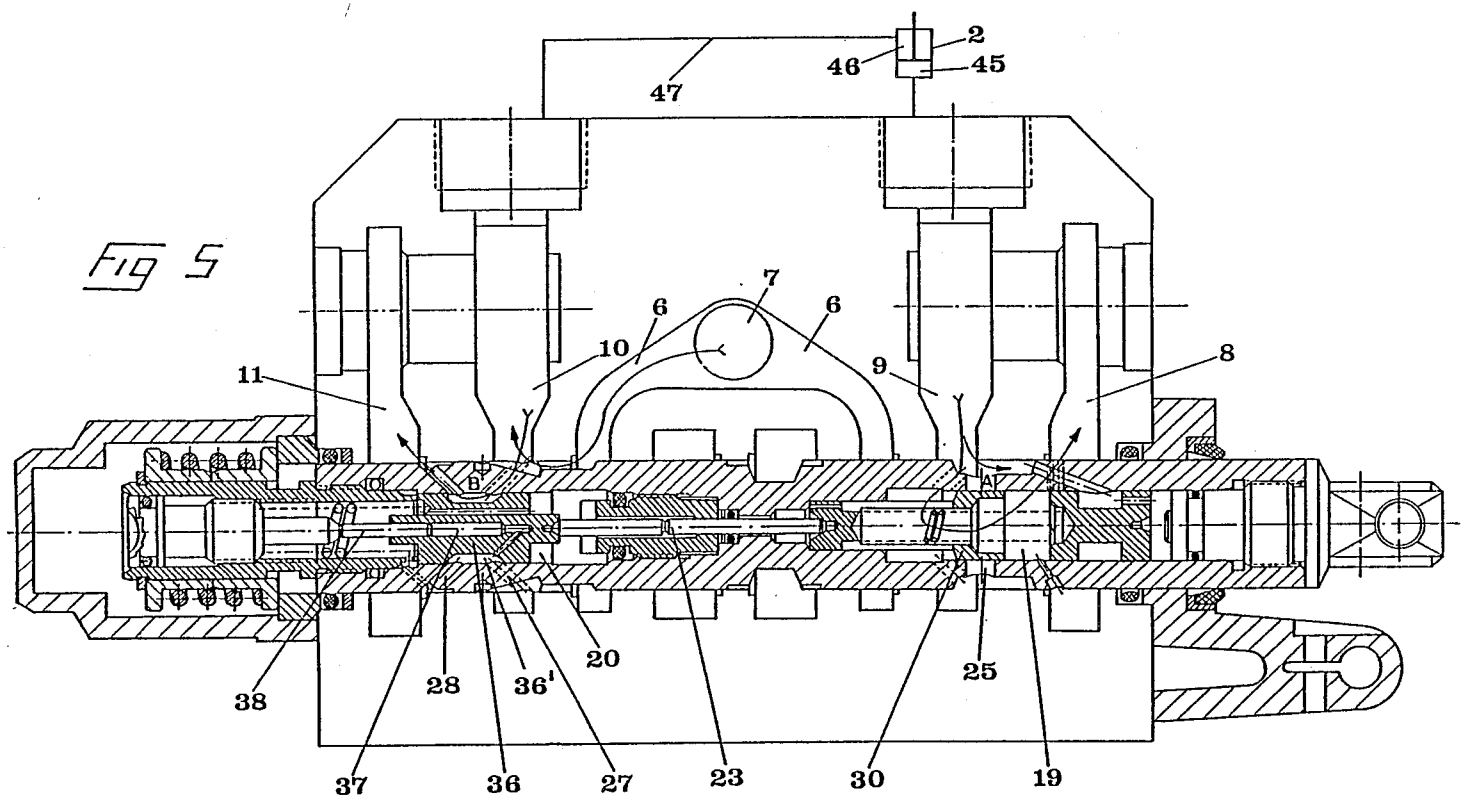
FIG. 5 shows a view similar to that in FIG. 3, with the runner in the same position as in FIG. 3, but with the system under a higher descent pressure.

Should the pressure rise even further, e.g. in the handling of a load equal to or close to the maximum, the moment will be reached in which plunger 30 will be moved, as the tension of spring 35 will be overcome. This spring is set to bear a thrust corresponding to pressure caused by a load equal to or close to the maximum. Plunger 30 moves to the position shown in FIG. 5, totally closing the set of holes 25. At the same time, the movement of plunger 30 through intermediate plunger 23 will have moved reel 36 to the position in FIG. 5, where part of the oil from the pump being delivered through ducts 6,10 and 47 to the withdrawal chamber 46 of cylinder 2 is bypassed, through holes 27 and 28 of chamber two 20, to duct 11, from where it is transferred to the storage tank. This reduces the amount of oil reaching the withdrawal chamber 46 of the plunger.

All the foregoing means that the pressures induced in the drive chamber 45 of the cylinder as a result of the entry of pressurised oil in the withdrawal chamber 46 are eliminated or reduced. At the same time, the oil flow speed is reduced, both in the return to the tank and in the supply to the cylinder withdrawal chamber, thus significantly reducing the crane's descent speed. On the other hand, the safety valve of the cylinder drive chamber is under pressure only from the load, because of the almost total reduction, or the removal, of the induced pressures.

The reduction in flow cancels the operation of the pilot block valve, preventing the flow from reaching the maximum limit during descent; it is at this point that said pilot valve would operate.

In this way, the mechanism in this invention makes it possible to function, as said, to control the flow as an inverse function of the load, reducing the effect of induced pressure, making the flow variation dependent only on the load, and eliminating the function of the pilot block valve.

The fixed rod 38 acts as a compensation element for induced pressures. The axial hole 37 is under pressure from the ring-shaped chamber or space 36'. For its part the central plunger 23 is under the pressure in chamber 19. The cross-section of the said rod 38 and of the axial hole 37 are, in relation to that of the central plunger 23, of the same proportion as those of the chambers of cylinder 2. The said pressure in hole 37 will tend to move reel 36 rightwards. Because of the proportions between this hole and the central plunger 23, the reel 36 and the axial hole 37 and rod 38 will act as compensatory components of the induced pressure.

Figure 6:
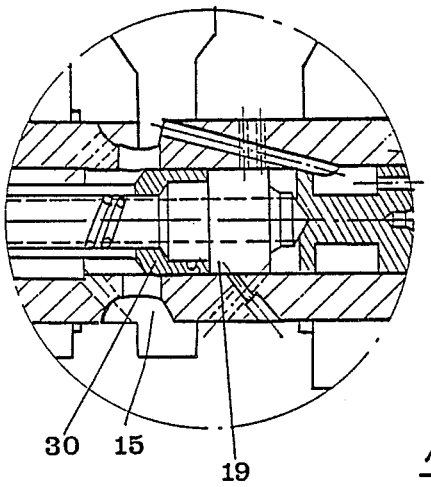
FIG. 6 shows detail A from FIG. 1, showing a variation in the design.
Figure 7:
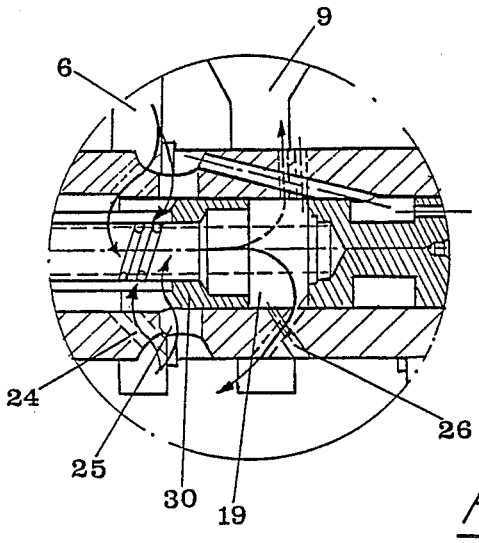
FIG. 7 is a detail showing the design variation of FIG. 6, with the runner in the same position as in FIG. 2, for the upward movement of the crane.

The same control is possible in the cylinder upward or lift phase. Here, the peripheral throat 15 is shortened, as shown in FIG. 6, where the position of the mechanism is the same as in FIG. 1. In the lift phase, plunger 30 is in the position shown in FIG. 7, so that the oil from the pump which flows through duct 6 will run into the chamber 19 through holes 24 and 25. The flow section of this second series of holes is regulated by plunger 30; the greater the pressure in chamber 19, the further to the left it will move. In other words, when the oil reaches the pressure of the maximum or near-maximum load (i.e., the maximum pressure), plunger 30 will be displaced to its leftward limit, so reducing the speed of the flow of oil through this chamber, from where it emerges through ducts 26 to reach duct 9, through which the oil reaches the drive chamber 45 of the cylinder. In this way, lift speed is reduced when maximum or near-maximum loads are being handled. In the downward position, the plunger 30 is in position 8, and the mechanism acts in the same way as in FIG. 3.

Figure 8:
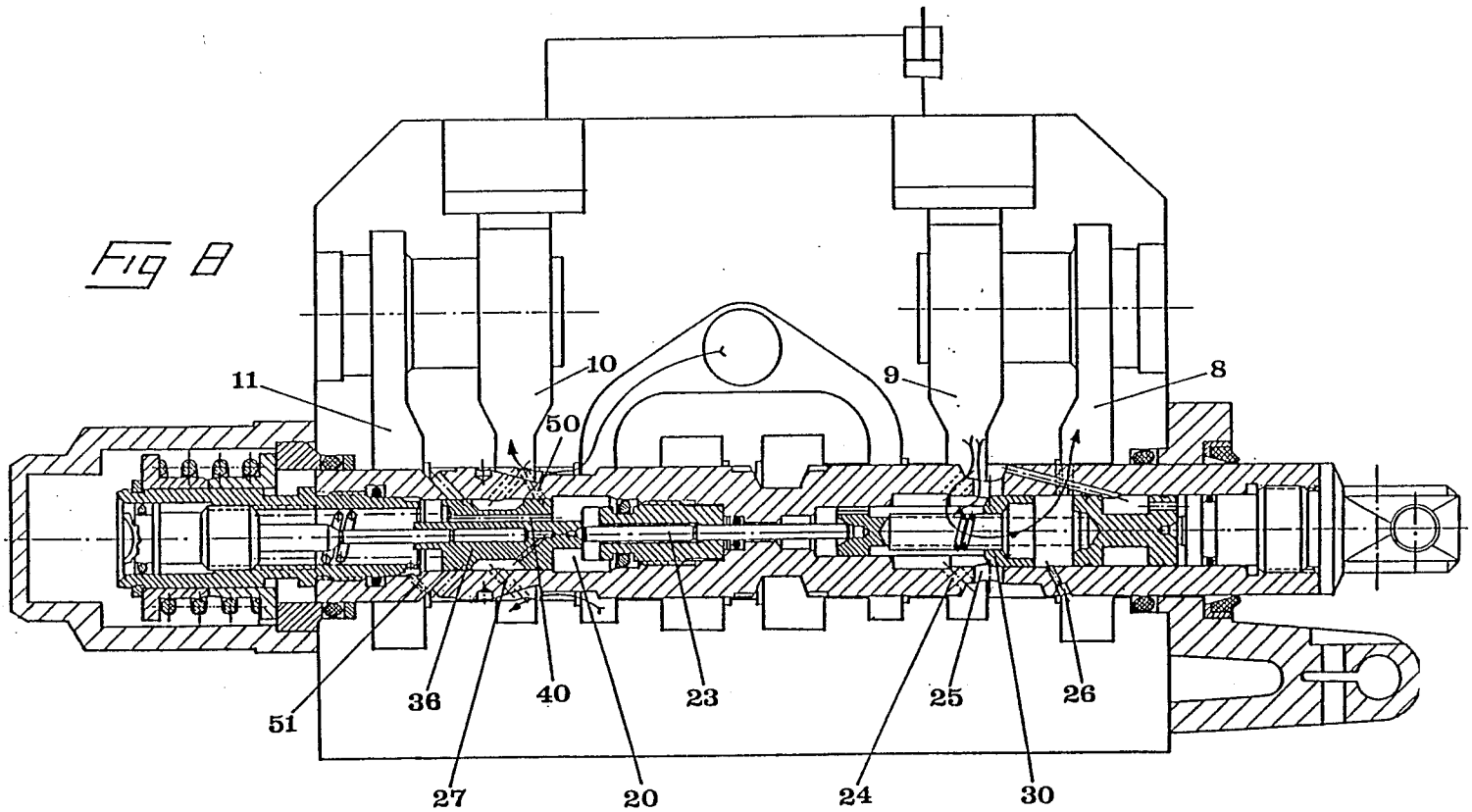
FIG. 8 shows the design variation of FIG. 6, with the runner in the same position as in FIG. 3, for crane descent.

Finally, in order to ensure the stability of the system in both the upward and downward crane operation, the second chamber 20 may have an auxiliary inclined hole 50 in its side, as shown in FIG. 8, made from a point close to or coinciding with the set of holes 27. With this hole or opening 50 (e.g. if the runner is in the downward position shown in FIG. 8), should the thrust from plunger 23 move the reel 36 to the left far enough to unblock the said opening 50, and this opening discharges into chamber 20, the oil delivered by the pump will run into this chamber and raise the pressure there. This will move the reel 36 leftwards once and for all even though the pressure transmitted by plunger 23 does not rise and may even drop. The assembly's stability is thus ensured. The oil which runs through the hole 50 to chamber 20 will flow through holes 40 and 51 to the return duct 11. The pressure in chamber 20 is thus regulated, at a level lower than that in duct 10.

Although throughout the foregoing description, reference has been made to the application of this distributor to cranes, it will be understood that the said distributor can be used not only for other types of lifting equipment, but also for all those apparatus and installations which involve hydraulic cylinders for the operation or control of any moving component or part.

Having thus sufficiently described the nature of the invention, and its practical design, it must be recorded that the foregoing specifications, also shown in the attached drawings, are susceptible to variations of detail insofar as they do not alter the basic principle.

I claim:

1. Distributor for hydraulic cylinders, including:

a body forming for each cylinder a through housing in which a runner is axially moveable;

two chambers for two safety valves;

two intermediate oil inlet ducts from a supply pump which run radially into said housing;

two ducts for the supply and return of oil for advance and withdrawal chambers of the cylinder, said ducts running between the housing and said chambers, one on each side of the intermediate oil inlet ducts; and two ducts for the return of the oil to a tank or deposit, which also run between the housing and the safety valve chambers, and being characterized in that said runner has two peripheral throats which provide intercommunication between certain of the ducts and is hollow and closed at both ends from which two separate chambers are formed, the first one of which is adjacent to the oil supply and return ducts from the cylinder advance chamber, and the second one of which is adjacent to the ducts for the supply and return of oil for said cylinder withdrawal chamber; one of said throat of the runner being located over each of these chambers, and the first of the said runner chambers comprising, in the side, three series of through holes, that two of these holes run from the surface of the adjacent peripheral throat, while the third runs from a point close to said throat, between the throat and the closest end of the runner, that the wall of the second chamber in the runner comprises two through holes, one of which runs from the surface of the adjacent peripheral throat, and the other from a point close to this throat, between the throat and the closest end of the runner, that the first chamber and holes of the runner form a passage for the circulation of oil between the supply and the return ducts of the oil for the cylinder advance chamber when the runner is in a downward position of the said cylinder, the peripheral throat outside the said chamber moving in this position axially in relation to the tank oil return duct as the oil runs from the cylinder advance chamber without providing an opening between this duct and the one for the supply of oil to the cylinder advance chamber;

that the second chamber and the walls in its side in the meantime form a passage, when the runner is in the same position, between the duct for the supply of oil to the cylinder withdrawal chamber and that for return to the tank, and that the first chamber has means for varying the size of the cross-section of the said passage, as a function of the return oil pressure from the cylinder withdrawal chamber comprising a first plunger alongside the runner end, which is designed to alter the size of the cross-section of the third set of holes of said chamber, while a second plunger has for its task to alter the cross-section of the intermediate set of holes, the base of said first plunger which is adjacent to the second plunger being subject to the pressure in the chamber plus the tension from a spring which is fitted between the two plungers; while the opposite base is subject to the pressure in the external peripheral throat which receives the duct for supply of oil to the cylinder advance chamber through an interconnecting port running off from the said throat, said second plunger having opposite bases of different cross-section, both of which are under the pressure from the chamber and, as well, from the spring located between the two plungers, on the one hand, and on the other, from an adjustable spring which is set to a value equal or close to the pressure due to a maximum load on the cylinder, while the second chamber has means for opening or closing the connection through the said chamber as a function of the pressure of the oil delivered from the pump to the duct for supply of oil to the cylinder withdrawal chamber.

2. Distributor according to claim 1, wherein the two holes (24,25) in the first chamber (19) which run off from the adjacent peripheral throat (15) are located close together, and define an opening which is smaller than the mouth on the runner in the duct for supply of oil to the cylinder advance chamber.

3. Distributor according to claim 1, wherein said second plunger (30) has two end heads and an intermediate body, the head closer to the first plunger (29) being of larger cross-section than the one opposite and the intermediate body being hollow and running into the chamber through lengthwise openings and through the head adjacent to the first plunger, said second plunger being movable between two limit positions, one for the full opening of the intermediate set of holes in the chamber, where it is displaced towards the first plunger, and the other for the complete closure of the said intermediate set of holes, in which it rests, by way of the smaller sized head, on a seat formed inside the chamber.

4. Distributor according to claim 1, wherein said second plunger (30), through the smaller sized head, rests against an intermediate plunger (23) of considerably smaller cross-section, which runs to the second chamber (16) by way of a passage with means for being hermetically sealed; said intermediate plunger being under pressure, on the one hand, from the first chamber and, on the other, from the tension of the adjustable spring (35) which operates on the second plunger (30).

5. Distributor according to claim 1, wherein the means in the second chamber (20) for opening or closing the passage through it are made up of a reel (36) which is fitted inside said chamber and can be moved axially, said reel consisting of two end heads whose cross-section is the same between them and as the internal dimension of the chamber, and an intermediate body of reduced cross-section which defines a ring-shaped space between the said heads and the internal surface of the chamber, the reel having, from its free base adjacent to the end of the runner, an axial port, which is closed, and between this port and the ring-shaped space there is an interconnection hole while, by way of the opposite base, it rests on the intermediate plunger which reaches the first chamber, a rod tightly fitted in the said axial opening being secured to an end plug (18) which is internally screwed into the second chamber, a spring between said plug and reel thrusting the runner towards the intermediate plunger, through which it acts on the second plunger in the first chamber so as to define the above-mentioned adjustable spring which is acting on the second plunger, said reel being moveable by the effect of the spring and of the second plunger in the first chamber, through the intermediate plunger, between two extreme positions; one of which is at the adjacent end of the runner, where the two sets of holes in the second chamber discharge into the ring-shaped space which is defined by the said reel, and the other one is in the opposite direction, where only the holes running from the bottom of the peripheral throat run into the said ring-shaped space, this throat being always connected to the duct for the supply of oil to the cylinder withdrawal chamber.

6. Distributor, according to claim 4, wherein the intermediate plunger and the fixed rod which is housed in the hole in the reel have transverse cross-sections which are of the same proportion as those of the plunger in the cylinder of the withdrawal and advance chambers.

7. Distributor according to claim 1, wherein the second chamber has, in its side, an inclined through hole which runs on the outside from a point close to or coinciding with the set of holes between the peripheral throat, and which discharges inside the said second chamber at a point which can be blocked by the runner in its intermediate position, and which is unblocked when the said runner is at or close to its maximum displacement towards the adjacent end of the runner.

* * * * *